US012241238B2

(12) United States Patent
Yang

(10) Patent No.: US 12,241,238 B2
(45) Date of Patent: Mar. 4, 2025

(54) CENTRAL CONTROL WATER PATH COMPONENT, BATHING SYSTEM AND CONTROL METHOD OF CENTRAL CONTROL WATER PATH COMPONENT

(71) Applicant: Shenzhen Weile Sanitary Ware Hardware and Electrical Appliance Building Materials Co., LTD, Shenzhen (CN)

(72) Inventor: Zhongxiong Yang, Shenzhen (CN)

(73) Assignee: Shenzhen Weile Sanitary Ware Hardware and Electrical Appliance Building Materials Co., LTD, Shenzhen (CN)

( * ) Notice: Subject to any disclaimer, the term of this patent is extended or adjusted under 35 U.S.C. 154(b) by 421 days.

(21) Appl. No.: 17/671,998

(22) Filed: Feb. 15, 2022

(65) Prior Publication Data

US 2022/0170248 A1 Jun. 2, 2022

Related U.S. Application Data

(63) Continuation of application No. PCT/CN2021/114597, filed on Aug. 25, 2021.

(30) Foreign Application Priority Data

Sep. 2, 2020 (CN) ..... 202010907639.3

(51) Int. Cl.
*E03C 1/04* (2006.01)
*E03C 1/046* (2006.01)
*E03C 1/02* (2006.01)

(52) U.S. Cl.
CPC ..... *E03C 1/046* (2013.01); *E03C 1/0408* (2013.01); *E03C 2001/026* (2013.01)

(58) Field of Classification Search
CPC ..... E03C 1/046; E03C 1/0408
See application file for complete search history.

(56) References Cited

U.S. PATENT DOCUMENTS 4,358,056 A 11/1982 Greenhut et al.
8,618,035 B2 * 12/2013 Lai ..... C11D 9/225 510/141

(Continued)

FOREIGN PATENT DOCUMENTS

CN 2620804 Y 6/2004
CN 1708624 A 12/2005

(Continued)

OTHER PUBLICATIONS

International Search Report and Written Opinion issued in corresponding PCT Application No. PCT/CN2021/114597, dated Nov. 22, 2021.

(Continued)

*Primary Examiner* — Kevin R Barss
(74) *Attorney, Agent, or Firm* — Westbridge IP LLC

(57) ABSTRACT

Disclosed are a central control water path component, a bathing system and a control method of the central control water path component. The central control water path component includes: a water path component including a water inlet structure, a water outlet structure and a water path pipeline, where the water path pipeline includes a main water path whose two ends are connected with the water inlet structure and the water outlet structure correspondingly, and a branch water path whose two ends are connected with the main water path; a bath liquid filter bottle installed on the water path component and having a bath liquid filter cavity for receiving a water-soluble bath substance and connected to the branch water path; and a switch installed at (Continued)

an intersection of the main water path and the branch water path to selectively control the water outlet structure.

9 Claims, 6 Drawing Sheets

(56) References Cited

U.S. PATENT DOCUMENTS

| | | | | |
|---|---|---|---|---|
| 9,096,995 | B1 * | 8/2015 | Al-Qaneei | E03C 1/0465 |
| 9,359,748 | B1 * | 6/2016 | Lamy | E03C 1/046 |
| 10,036,148 | B1 * | 7/2018 | Rodriguez | E03C 1/04 |
| 11,536,012 | B2 * | 12/2022 | Samain | A45D 19/16 |
| 2013/0161358 | A1 * | 6/2013 | Tsai | B67D 7/62 222/325 |
| 2015/0083748 | A1 * | 3/2015 | McHale | E03C 1/057 222/52 |
| 2017/0050199 | A1 * | 2/2017 | Farcet | B05B 7/08 |
| 2017/0107704 | A1 * | 4/2017 | Wang | A47K 5/14 |
| 2017/0356171 | A1 * | 12/2017 | Wilson | E03C 1/084 |
| 2018/0103807 | A1 * | 4/2018 | Burgo, Sr. | E03C 1/046 |
| 2018/0355591 | A1 * | 12/2018 | Saro | E03C 1/0409 |
| 2018/0371727 | A1 * | 12/2018 | Mercieca | E03C 1/046 |
| 2019/0048567 | A1 * | 2/2019 | Hughes | E03C 1/0408 |
| 2019/0059659 | A1 * | 2/2019 | Burgo, Sr. | A47K 5/1217 |
| 2019/0060926 | A1 * | 2/2019 | Benitez | B05B 15/65 |
| 2019/0078306 | A1 * | 3/2019 | Estelhomme | E03C 1/0409 |
| 2019/0254485 | A1 * | 8/2019 | Stout | A61H 33/0095 |

FOREIGN PATENT DOCUMENTS

| | | | |
|---|---|---|---|
| CN | 201537035 | U | 8/2010 |
| CN | 108643286 | A | 10/2018 |
| CN | 208803536 | U | 4/2019 |
| CN | 210207264 | U | 3/2020 |
| CN | 210842804 | U | 6/2020 |
| CN | 211359244 | U | 8/2020 |
| CN | 111877467 | A | 11/2020 |
| CN | 212896637 | U | 4/2021 |
| JP | 2004113870 | A | 4/2004 |
| WO | 2008058215 | A2 | 5/2008 |

OTHER PUBLICATIONS

First Office Action issued in counterpart Chinese Patent Application No. 202010907639.3, dated Jan. 1, 2025.

* cited by examiner

CENTRAL CONTROL WATER PATH COMPONENT, BATHING SYSTEM AND CONTROL METHOD OF CENTRAL CONTROL WATER PATH COMPONENT

CROSS-REFERENCE TO RELATED APPLICATIONS

This application is a continuation of International Application PCT/CN2021/114597, filed on Aug. 25, 2021, which claims priority to Chinese Patent Application 202010907639.3, filed on Sep. 2, 2020, the entire contents of which are incorporated herein by reference.

TECHNICAL FIELD

This application relates to the technical field of bathing products, in particular to a central control water path component, a bathing system and a control method of the central control water path component.

BACKGROUND

With the continuous development of science and technology, people's demand for quality of life is getting higher and higher. In a process of bathing, users usually need to get wet with a shower, and then apply shower gel/shampoo to wash. The process is cumbersome and not conducive to improve the convenience of bathing for users.

SUMMARY

The main purpose of this application is to provide a central control water path component, aiming at improving the convenience of bathing for users.

In order to achieve the above purpose, the central control water path component proposed in this application includes:

a water path component including a water inlet structure, a water outlet structure and a water path pipeline, in particular the water path pipeline includes a main water path with two ends connected with the water inlet structure and the water outlet structure correspondingly, and a branch water path with two ends connected with the main water path;

a bath liquid filter bottle installed on the water path component and having a bath liquid filter cavity for receiving a water-soluble bath substance and connected to the branch water path; and a switch installed at an intersection of the main water path and the branch water path to selectively control the water outlet structure to output clear water or bath liquid.

In an embodiment, the water path component is in a flat board shape, and a plurality of retaining walls connecting an upper plate surface and a lower plate surface are arranged in the water path component to form the main water path and the branch water path.

In an embodiment, the main water path includes a water inlet section, a parallel section and a common section sequentially along the water flow direction, a water inlet end of the branch water path is connected with the water inlet section, a water outlet end of the branch water path is connected with a water inlet of the bath liquid filter bottle, and a water outlet of the bath liquid filter bottle is connected with the common section.

In an embodiment, the switch corresponds to the intersection of the main water path and the branch water path, and is extended through an outer wall of the water path component and the plurality of retaining walls, to allow a user to press or rotate the switch to control the water outlet structure to output the clear water or the bath liquid.

In an embodiment, a manner in which the water outlet structure outputs the clear water or the bath liquid is controlled based on the user pressing the switch, the plurality of retaining walls include a first partition plate arranged at the intersection of the main water path and the branch water path, the first partition plate is configured for separating the main water path and the branch water path, the first partition plate is provided with a first water-passing hole for receiving the switch, and an outer peripheral wall of the switch is recessed to form a first water-passing tank; when the first water-passing tank is arranged in the first water-passing hole, the clear water is conducted to the branch water path from the main water path through a passage between a wall of the first water-passing hole and a wall of the first water-passing tank.

In an embodiment, the plurality of the retaining walls include a second partition plate arranged at the intersection of the main water path and the branch water path, the second partition plate is configured for separating the water inlet section and the parallel section, the second partition plate is provided with a second water-passing hole for receiving the switch, and the outer peripheral wall of the switch is recessed to form a second water-passing tank; when the second water-passing tank is arranged in the second water-passing hole, the clear water is conducted to the parallel section from the water inlet section through a passage between a wall of the second water-passing hole and a wall of the second water-passing tank.

The technical proposal of the present application, through a water path passage of the water path component, a main water path connected with a water inlet structure and a water outlet structure and a branch water path parallel to the main water path are separated and formed, so as to realize double-channel diversion between the water outlet structure and the water inlet structure, further, by installing a bath liquid filter bottle on the water path component, so that the bath liquid filter cavity of the bath liquid filter bottle is connected into the water path. Finally, a switcher is installed at the intersection of the main water path and the branch water path near the water inlet structure, so that the user can control the water flow channel and independently select the water outlet to discharge clear water or bath liquid, thus avoiding the tedious process of smearing bath liquid and the like during bathing, and improving the convenience of bathing for the user.

In an embodiment, when the clear water is conducted to the branch water path from the water inlet section, the first water-passing tank is correspondingly located in the first water-passing hole and the second water-passing tank is correspondingly located outside the second water-passing hole;

when the clear water is conducted to the parallel section from the water inlet section, the first water-passing tank is correspondingly located outside the first water-passing hole, and the second water-passing tank is correspondingly located in the second water-passing hole.

In an embodiment, the water-soluble bath substance is a bath soap containing vitamins C and E.

The present application further provides a bathing system including the central control water path component, the central control water path component includes:

a water path component including a water inlet structure, a water outlet structure and a water path pipeline, in particular the water path pipeline includes a main water path with two ends connected with the water inlet structure and the water outlet structure correspondingly, and a branch water path with two ends connected with the main water path;

a bath liquid filter bottle installed on the water path component 1 and having a bath liquid filter cavity for receiving a water-soluble bath substance and connected to the branch water path; and a switch installed at an intersection of the main water path and the branch water path to selectively control the water outlet structure to output clear water or bath liquid.

The present application further provides a control method for a central control water path component, including following steps:

S1, adjusting a switch of a central control water path component to a first state to open a branch water path of the central control water path component, to let water flow through a bath liquid filter bottle in the branch water path to be converted into bath liquid and discharged;

S2, adjusting the switch of the central control water path component to a second state to close the branch water path of the central control water path component, to let the water flow through a main water path in the central control water path component and be discharged directly.

BRIEF DESCRIPTION OF THE DRAWINGS

In order to more clearly explain the embodiments of the present application or the technical solution in the related art, the drawings required for use in the description of embodiments or related art will be briefly described below. It will be apparent that the drawings described below are only some embodiments of the present application, and other drawings may be obtained from the structure shown in these drawings without any creative effort by those of ordinary skill in the art.

Figure 1:
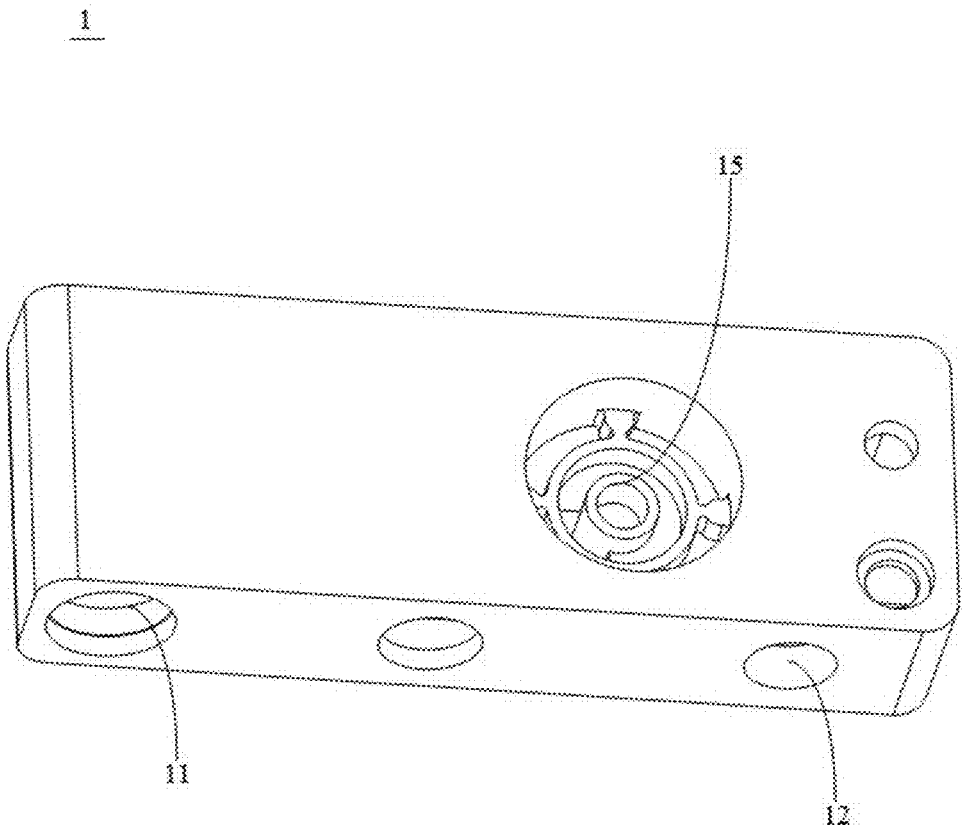
FIG. 1 is a structural view of a water path component of a central control water path component of the present application.
Figure 2:
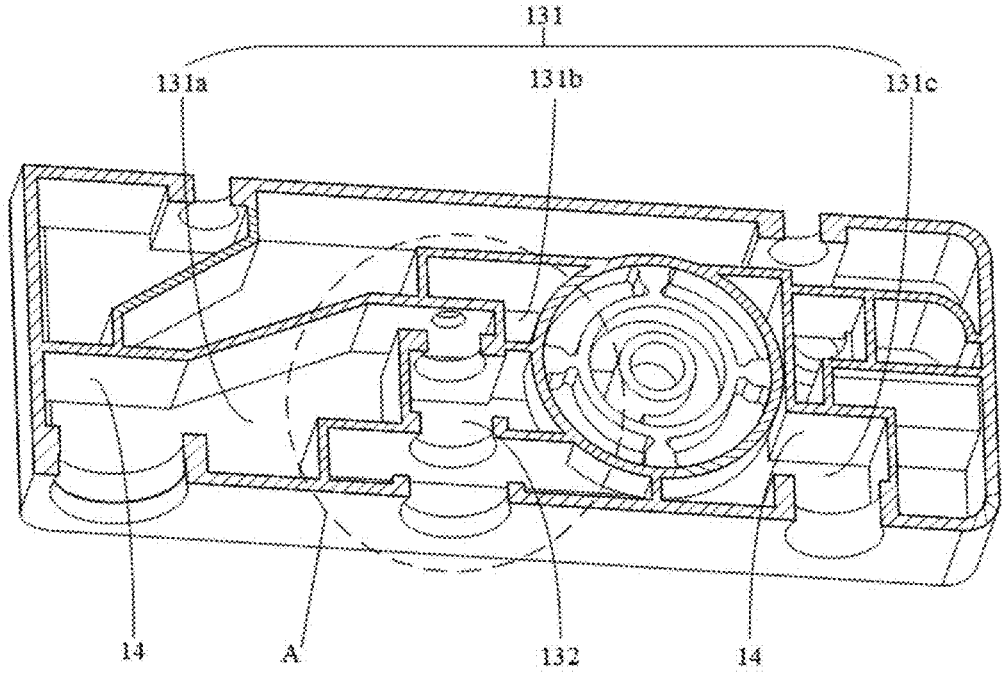
FIG. 2 is a cross-sectional view of the water path component of FIG. 1.
Figure 3:
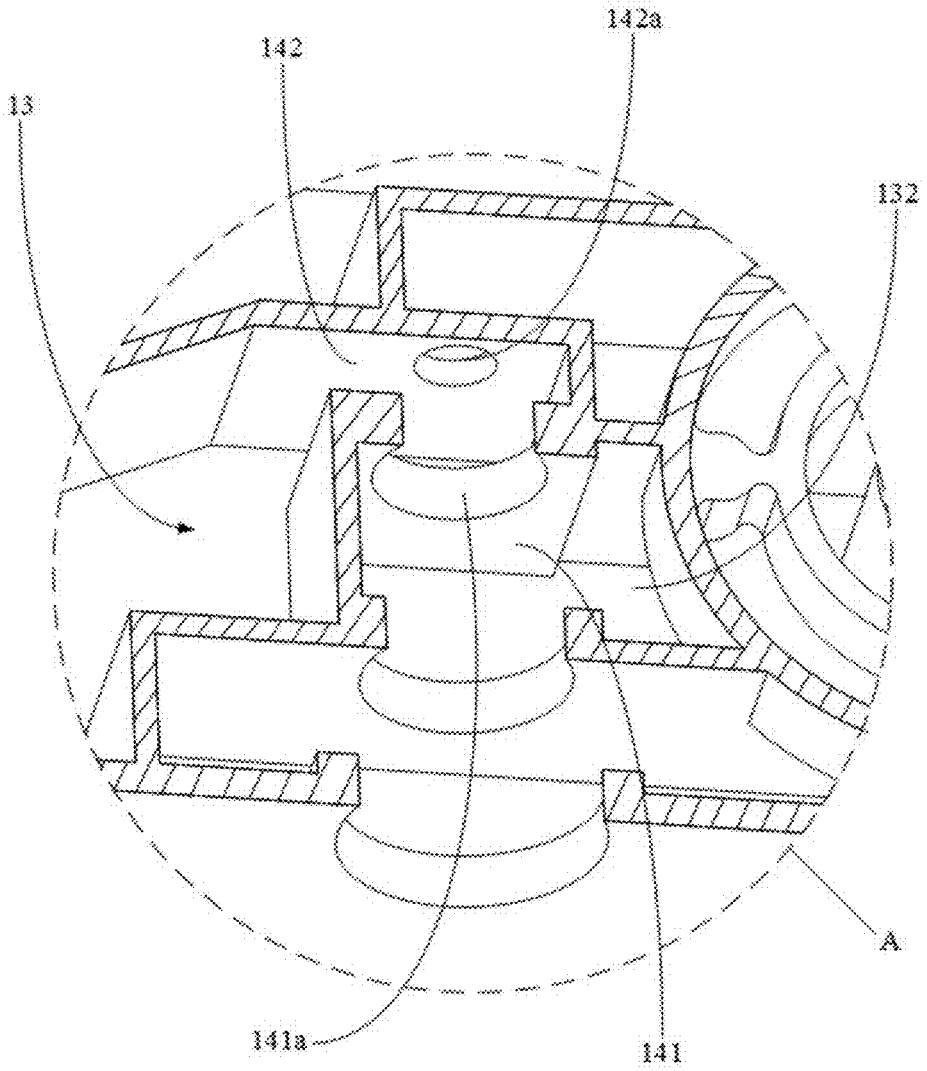
FIG. 3 is an enlarged view of portion A of FIG. 2.
Figure 4:
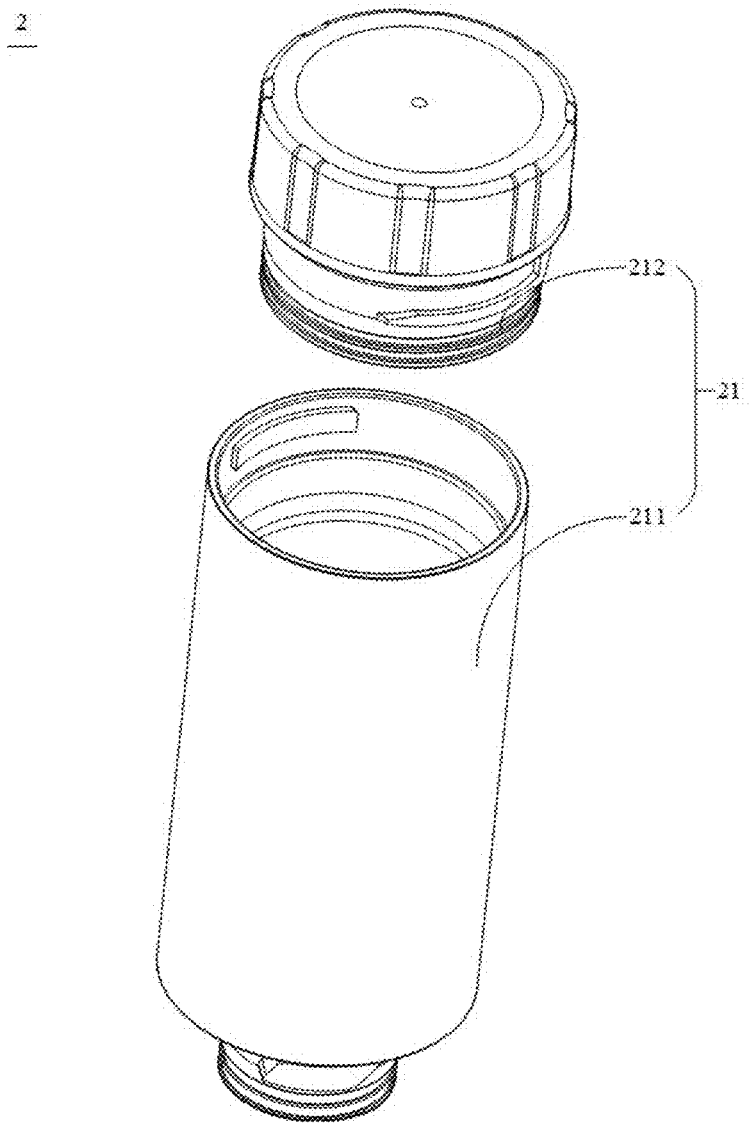
FIG. 4 is an explosion view of a bath liquid filter bottle of the central control water path component of the present application.
Figure 5:
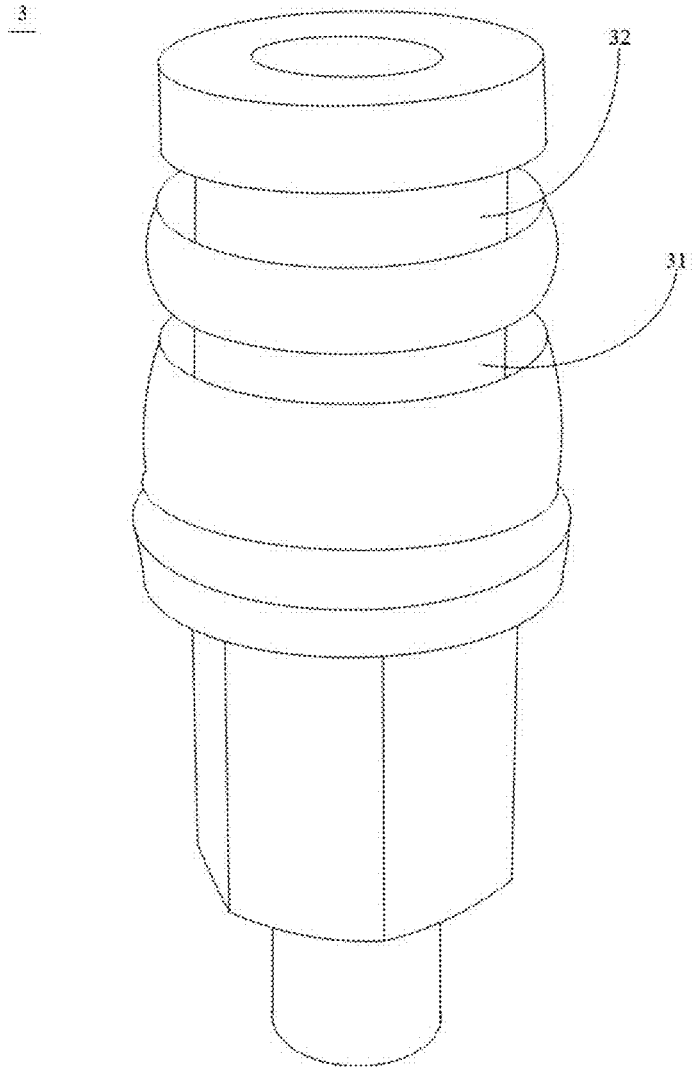
FIG. 5 is a structural view of a switch of the central control water path component of the present application.

The realization of the objective, functional features and advantages of the present application will be further explained with reference to the accompanying drawings in connection with the embodiments.

DETAILED DESCRIPTION OF THE EMBODIMENTS

A clear and complete description of the technical aspects of the embodiments of the present application will be given below in conjunction with the accompanying drawings in the embodiments of the present application, and it will be apparent that the described embodiments are only parts of the embodiments of the present application, not all of them. Based on the embodiments in the present application, all other embodiments obtained by those of ordinary skill in the art without making creative efforts fall within the scope of the present application.

It should be noted that if there is a directivity indication (such as up, down, left, right, front, back, etc.) in the embodiment of the present application, the directivity indication is only used to explain the relative positional relationship and motion among the components under a specific posture (as shown in the drawing), and if the specific posture changes, the directivity indication will change accordingly.

In addition, if there are descriptions referring to "first", "second" and the like in embodiments of the present application, the descriptions of "first", "second" and the like are for descriptive purposes only and cannot be understood as indicating or implying their relative importance or implying the number of technical features indicated. Thus, the features defined as "first", "second" may explicitly or implicitly include at least one of the features. In addition, the technical solutions among the various embodiments may be combined with each other, but must be on a basis that the person of ordinary skill in the art can realize it. When the combination of technical solutions conflicts or cannot be realized, it should be considered that the combination of technical solutions does not exist and is not within the scope of the present application.

The present application provides a central control water path component.

In an embodiment of the present application, according to FIGS. 1 to 5, the central control water path component includes:

a water path component 1 including a water inlet structure 11, a water outlet structure 12 and a water path pipeline 13, where the water path pipeline 13 includes a main water path 131 with two ends respectively connected with the water inlet structure 11 and the water outlet structure 12, and a branch water path 132 with two ends are connected with the main water path 131;

a bath liquid filter bottle 2 installed on the water path component 1 and having a bath liquid filter cavity for receiving a water-soluble bath substance and connected to the branch water path 132; and a switch 3 installed at an intersection of the main water path 131 and a branch water path 132 to selectively control the water outlet structure 12 to output clear water or bath liquid.

Understandably, the water inlet structure 11 of the water path component 1 can be a double-flow water inlet (cold water and hot water) or single-flow water inlet, when the water inlet of the water path component 1 is a double-flow water inlet, the water path component 1 further includes a water mixing valve arranged on the main water path 131 and located between the water inlet structure 11 and the intersection of the main water path 131 and the branch water path 132 to effectively mix cold water and hot water. In addition, when the water outlet structure 12 has a plurality of water outlets, the central control water path component is further equipped with a water path distributor at the water outlet structure 12 to guide each water path. Without losing generality, the water outlet structure 12 includes a shower outlet, a faucet outlet and a hand-held outlet. In this embodiment, the central control water path component is further provided with a water outlet control switch at one end of the main water path 131 close to the water outlet structure 12 for a user to control opening and closing of the water outlet structure 12, therefore enriching the practicability of the central control water path component.

In this embodiment, the bath liquid filter bottle 2 includes a filter case 21 for being mounted and fixed to the water path component 1, and the water-soluble bath substance are received in the filter case. The filter case includes a cylindrical case 211 and a cover 212. One end of the cylindrical case 211 is connected with the water path component 1, and the other end is detachably covered by the end cover 212. This arrangement is convenient for users to quickly and conveniently replace the water-soluble bath substance in the filter case 21 and improves user experience. Without losing generality, the water-soluble bath substance is a bath soap containing vitamin C and E. It is not difficult to understand that the bath soap containing vitamins C and E has effects of whitening skin, preventing color spots and the like, and can effectively improve a bathing experience. It should be noted that the design is not limited to this. In other embodiments, the water-soluble bath substance can further be a bath soap made of other materials, which is not limited here.

In the technical proposal of the present application, a main water path 131 which communicates with a water inlet structure 11 and a water outlet structure 12, and a branch water path 132 which is connected to the main water path 131 are formed on a water path passage of the water path component 1, so as to realize a dual-channel diversion between the water outlet structure 12 and the water inlet structure 11. Further, by mounting a bath liquid filter bottle 2 on the water path component 1, a bath liquid filter cavity of the bath liquid filter bottle 2 is connected to the branch water path 132. Finally, a switch 3 is installed at an intersection of the main water path 131 and the branch water path 132 near the water inlet structure 11, so that the user can control the water flow channels and independently select to discharge clear water or bath liquid from the water outlet, thereby avoiding a tedious process of applying bath liquid and the like during bathing, and improving convenience of bathing for the users.

In one embodiment, the water path component 1 has a flat board shape, and a plurality of retaining walls 14 connecting upper and lower plate surfaces are arranged in the water path component 1 to form the main water path 131 and the branch water path 132. Understandably, with this setting, on one hand, the flat board structure commonly used by the water path component 1 is adopted, thereby reducing a design difficulty of the water path component 1, on the other hand, the retaining walls 14 are adopted to divide the internal space of the water path component 1, so that space ratios of the main water path 131 and the branch water path 132 can be flexibly planned according to the users' requirements in the production flow. without losing generality, a bottom plate of the water path component 1 is provided with a filter bottle interface 15, and the cylindrical case 211 of the bath liquid filter bottle 2 can be detachably installed on the filter bottle interface 15 and arranged vertically. It should be noted that the present application is not limited thereto, in other embodiments, the water path component 1 may be designed in another shape without limitation.

In one embodiment, the main water path 131 includes a water inlet section 131*a*, a parallel section 131*b* and a common section 131*c* sequentially along the water flow direction. The water inlet end of the branch water path 132 is connected to the water inlet section 131*a*, the water outlet end of the branch water path 132 is connected to the water inlet of the bath liquid filter bottle 2, and the water outlet of the bath liquid filter bottle 2 is connected to the common section 131*c*. Understandably, both ends of the parallel section 131*b* are communicated with the water inlet section 131*a*, a free end of the water inlet section 131*a* is connected to the water inlet. A free end of the common section 131*c* is connected to the water outlet structure 12. In this embodiment, both ends of the branch water path 132 which is for connecting the bath liquid filter bottle 2 are connected to the main water path 131 for diversion. The both ends of the branch water path 132 are not directly connected with the water inlet structure 11 and the water outlet structure 12, so that a space of the product can be effectively reduced and an appearance of the product can be improved. Of course, the present application is not limited to this. In other embodiments, the branch water path 132 can be directly connected with the water inlet structure 11 and the water outlet structure 12 for diversion, and there is no restriction on this.

In one embodiment, the switch 3 corresponds to the intersection of the main water path 131 and the branch water path 132, and is extended through the outer wall of the water path component 1 and the plurality of retaining walls 14 for a user to press or rotate the switch 3 to control the water outlet structure 12 to output clear water or bath liquid. It can be understood that by adopting the pressing or rotating control mode, the operation is simple and the control is convenient, and the convenience and flexibility of user operation can be effectively improved. It should be noted that the present application is not limited thereto and in other embodiments the switch 3 may specifically control the water outlet structure 12 to output clear water or bath liquid in other ways.

In one embodiment, a manner in which the water outlet structure 12 outputs clear water or bath liquid is controlled based on a user pressing the switch 3. The plurality of retaining walls 14 include a first partition plate provided at the intersection of the main water path 131 and the branch water path 132. The first partition plate is configured for separating the main water path 131 and the branch water path 132. The first partition plate is provided with a first water-passing hole 141*a* for receiving the switch 3. An outer peripheral wall of the switch 3 is recessed to define a first water-passing tank 31. When the first water-passing tank 31 is placed in the first water-passing hole 141*a*, the clear water flows from the main water path 131 into the branch water path 132 through a passage formed between the wall of the first water-passing hole 141*a* and the wall of the first water-passing tank 31. Understandably, the switch 3 is movable in an axis direction of the first water-passing hole 141*a*, when the first water-passing tank 31 is moved outside the first water-passing hole 141*a*, the outer peripheral wall of the switch 3 can be inserted in the first water-passing hole 141*a* in interference, so that the water flow passage between the main water-passing 131 and the branch water path 132 is sealed and closed, and the water flows from the water inlet structure 11 to the water outlet structure 12 through the main water path 131, so that the water outlet structure 12 only outputs clear water. When the first water-passing tank 31 is moved into the first water-passing hole 141*a*, the water can flow into the branch water path 132 from the gap between the first water-passing hole 141*a* and the first water-passing tank 31, and then enter the bath liquid filter cavity, and mix with bath soap to form bath liquid and output to the water outlet structure 12. At this time, the water outlet structure 12 outputs a mixture of clear water and bath liquid.

In one embodiment, the plurality of retaining walls 14 include a second partition plate provided at the intersection of the main water path 131 and the branch water path 132. The second partition plate is configured for separating the water inlet section 131*a* and the parallel section 131*b*. The second partition plate is provided with a second water-passing hole 142 for receiving the switch 3. The outer peripheral wall of the switch 3 is recessed with a second water-passing tank 32. When the second water-passing tank 32 is placed in the second water-passing hole 142, the clear water flows into the parallel section 131*b* from the water inlet section 131*a* through a passage formed between the wall of the second water-passing hole 142 and the wall of the second water-passing tank 32. Understandably, the switch 3 is movable in the axis direction of the second water-passing hole 142. When the second water-passing tank 32 is moved outside the second water-passing hole 142, the outer peripheral wall of the switch 3 can be inserted in the second water-passing hole 142 in interference, so that the water flow passage between the water inlet section 131*a* and the parallel section 131*b* is sealed and closed, and the water can only pass through the first water-passing hole 141*a* and flow from the water inlet section 131*a* to the branch water path 132, at which time the water outlet structure 12 can only output a mixture of clear water and bath liquid. When the second water-passing tank 32 is moved into the second water-passing hole 142, the water can flow from the water inlet section 131*a* into the parallel section 131*b* from the gap between the second water-passing hole 142 and the second water-passing tank 32, and then output to the water outlet structure 12. At this time, the water outlet structure 12 outputs clear water.

In one embodiment, when clear water flows into the branch water path 132 from the water inlet section 131*a*, the first water-passing tank 31 is correspondingly located in the first water-passing hole 141*a*, and the second water-passing channel 32 is correspondingly located outside the second water-passing hole 142. When clear water flows from the water inlet section 131*a* into the parallel section 131*b*, the first water-passing channel 31 is correspondingly located outside the first water-passing hole 141*a*, and the second water-passing channel 32 is correspondingly located inside the second water-passing hole 142. It can be understood that when the user only needs the water outlet structure 12 to output the bath liquid, the user can adjust a position of the switch 3, so that the water can only flow into the branch water path 132 from the water inlet section 131*a*, therefore avoiding the phenomenon that the water flows to the parallel section 131*b*, resulting in insufficient concentration of the outputted bath liquid and poor bath effect. When the user only needs the water outlet structure 12 to output clear water, the position of the switch 3 can be adjusted so that the water can only flow into the parallel section 131*b* from the water inlet section 131*a*, therefore avoiding the phenomenon that the water flows to the branch water path 132, resulting in mixing bath liquid in the output clear water, which is beneficial to improve the bathing experience of the user.

The present application further provides a bathing system, the bathing system includes a central control water path component, and a specific structure of the central control water path component refers to the above embodiments. Since the bathing system adopts all the technical schemes of the above embodiments, it has at least all the beneficial effects brought by the technical schemes of the above embodiments, which will not be repeated here.

Figure 6:
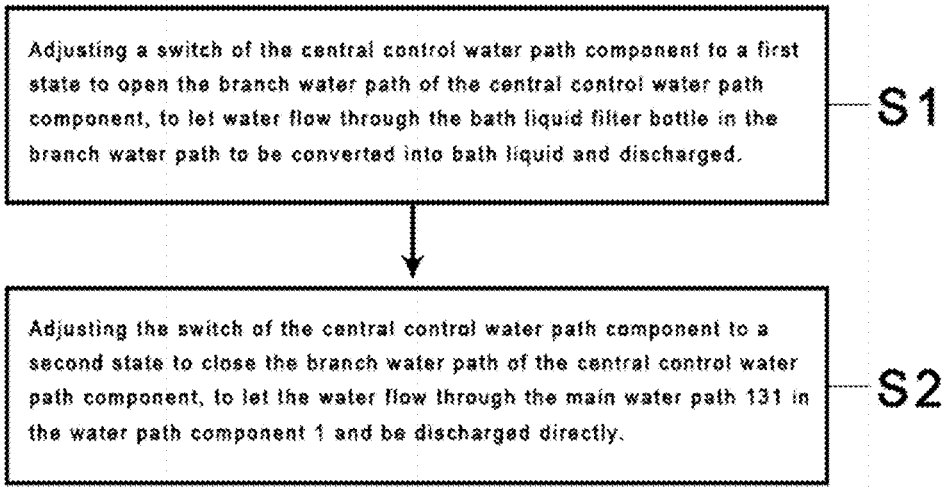
FIG. 6 is a flow diagram of steps of a control method of the present application.

The present application further provides a control method of a central control water path component. A specific structure of the central control water path component in the control method refers to the above embodiments, as shown in FIG. 6, the control method includes the following steps:

S1, adjusting a switch of the central control water path component to a first state to open the branch water path of the central control water path component, to let water flow through the bath liquid filter bottle in the branch water path to be converted into bath liquid and discharged.

It is easy to understand that, the user presses the switch 3, so that the first water-passing channel 31 of the switch 3 is disposed in the first water-passing hole 141*a* of the first baffle plate 141. The second water-passing tank 32 of the switch 3 is disposed outside the second water-passing hole 142 of the second partition plate 142*a*. This is a first state of the switch 3, at this time, a water flow passage between the water inlet section 131*a* of the main water path 131 and the branch water path 132 is opened, and a water flow passage between the water inlet section 131*a* of the main water path 131 and the parallel section 131*b* of the main water path 131 is closed. The water flows into the branch water path 132 from the water inlet section 131*a*, mixes with the water-soluble bath substance in the bath liquid filter bottle 2 to form bath liquid, and then flows to the water outlet structure 12 and is discharged.

S2, adjusting the switch of the central control water path component to a second state to close the branch water path of the central control water path component, to let the water flow through the main water path 131 in the water path component 1 and be discharged directly.

It is easy to understand that, the user moves out the switch 3, so that the first water-passing tank 31 of the switch 3 is disposed outside the first water-passing hole 141*a* of the first partition plate 141, the second water-passing tank 32 of the switch 3 is disposed in the second water-passing hole 142 of the second partition plate 141. In the second state of the switch 3, the water flow passage between the water inlet section 131*a* of the main water path 131 and the branch water path 132 is closed, the water flow passage between the water inlet section 131*a* of the main water path 131 and the parallel section 131*b* of the main water path 131 is opened, and the water flows from the water inlet section 131*a* into the parallel section 131*b*, and then flows to the water outlet structure 12 and is discharged.

The above is only a preferred embodiment of the present application, and is not therefore limiting the patent scope of the present application. Any equivalent structural transformation made by using the contents of the specification and drawings of the present application or any direct/indirect application in other related technical fields under the inventive concept of the present application is included in the scope of the present application.

The invention claimed is:

1. A central control water path component for a bathing system comprising:

a water path component comprising a water inlet structure, a water outlet structure and a water path pipeline, wherein the water path pipeline comprises a main water path with two ends connected with the water inlet structure and the water outlet structure correspondingly, and a branch water path with two ends connected with the main water path;

a bath liquid filter bottle installed on the water path component and having a bath liquid filter cavity for receiving a water-soluble bath substance and connected to the branch water path; and a switch installed at an intersection of the main water path and the branch water path to selectively control the water outlet structure to output clear water or bath liquid, wherein the water path component is in a flat board shape, and a plurality of retaining walls connecting an upper plate surface and a lower plate surface are arranged in the water path component to form the main water path and the branch water path.

2. The central control water path component according to claim 1, wherein the main water path comprises a water inlet section, a parallel section and a common section sequentially along the water flow direction, a water inlet end of the branch water path is connected with the water inlet section, a water outlet end of the branch water path is connected with a water inlet of the bath liquid filter bottle, and a water outlet of the bath liquid filter bottle is connected with the common section.

3. The central control water path component according to claim 2, wherein the switch corresponds to the intersection of the main water path and the branch water path, and is extended through an outer wall of the water path component and the plurality of retaining walls, to allow a user to press or rotate the switch to control the water outlet structure to output the clear water or the bath liquid.

4. The central control water path component according to claim 3, wherein a manner in which the water outlet structure outputs the clear water or the bath liquid is controlled based on the user pressing the switch, the plurality of retaining walls comprise a first partition plate arranged at the intersection of the main water path and the branch water path, the first partition plate is configured for separating the main water path and the branch water path, the first partition plate is provided with a first water-passing hole for receiving the switch, and an outer peripheral wall of the switch is recessed to form a first water-passing tank; when the first water-passing tank is arranged in the first water-passing hole, the clear water is conducted to the branch water path from the main water path through a passage between a wall of the first water-passing hole and a wall of the first water-passing tank.

5. The central control water path component according to claim 4, wherein the plurality of the retaining walls comprise a second partition plate arranged at the intersection of the main water path and the branch water path, the second partition plate is configured for separating the water inlet section and the parallel section, the second partition plate is provided with a second water-passing hole for receiving the switch, and the outer peripheral wall of the switch is recessed to form a second water-passing tank; when the second water-passing tank is arranged in the second water-passing hole, the clear water is conducted to the parallel section from the water inlet section through a passage between a wall of the second water-passing hole and a wall of the second water-passing tank.

6. The central control water path component according to claim 5, wherein when the clear water is conducted to the branch water path from the water inlet section, the first water-passing tank is correspondingly located in the first water-passing hole and the second water-passing tank is correspondingly located outside the second water-passing hole;

when the clear water is conducted to the parallel section from the water inlet section, the first water-passing tank is correspondingly located outside the first water-passing hole, and the second water-passing tank is correspondingly located in the second water-passing hole.

7. The central control water path component according to claim 1, wherein the water-soluble bath substance is a bath soap containing vitamins C and E.

8. A bathing system comprising the central control water path component according to claim 1.

9. A control method for a central control water path component, wherein the central control water path component comprises:

a water path component comprising a water inlet structure, a water outlet structure and a water path pipeline, wherein the water path pipeline comprises a main water path with two ends connected with the water inlet structure and the water outlet structure correspondingly, and a branch water path with two ends connected with the main water path;

a bath liquid filter bottle installed on the water path component and having a bath liquid filter cavity for receiving a water-soluble bath substance and connected to the branch water path; and a switch installed at an intersection of the main water path and the branch water path to selectively control the water outlet structure to output clear water or bath liquid, wherein the water path component is in a flat board shape, and a plurality of retaining walls connecting an upper plate surface and a lower plate surface are arranged in the water path component to form the main water path and the branch water path, and the control method comprises following steps:

S1, adjusting the switch of the central control water path component to a first state to open the branch water path of the central control water path component, to let water flow through the bath liquid filter bottle in the branch water path to be converted into bath liquid and discharged; and S2, adjusting the switch of the central control water path component to a second state to close the branch water path of the central control water path component, to let the water flow through the main water path in the central control water path component and be discharged directly.

* * * * *